United States Patent [19]

Schroeder et al.

[11] 4,158,873

[45] Jun. 19, 1979

[54] DEMAGNETIZING METHODS AND APPARATUS

[75] Inventors: Kenneth W. Schroeder, Arlington Heights; Bruce G. Isaacson, Park Ridge; Donald E. Lorenzi, Des Plaines, all of Ill.

[73] Assignee: Magnaflux Corporation, Chicago, Ill.

[21] Appl. No.: 829,442

[22] Filed: Aug. 31, 1977

[51] Int. Cl.[2] ..... H01F 13/00

[52] U.S. Cl. ..... 361/149; 361/267

[58] Field of Search ..... 361/149, 267

[56] References Cited

U.S. PATENT DOCUMENTS

| | | | |
|---|---|---|---|
| 2,677,802 | 5/1954 | Irwin | 361/149 |
| 3,086,148 | 4/1963 | Soneki | 361/149 |
| 3,582,721 | 6/1971 | Van Hoorn et al. | 361/149 |
| 3,619,729 | 11/1971 | Littwin | 361/149 |

OTHER PUBLICATIONS

*IEEE Transactions On Magnetics,* vol. Mag-12, No. 4, pp. 385-389, Jul. 1976, article by Mohri.

*Primary Examiner*—Gerald Goldberg
*Attorney, Agent, or Firm*—Van Metre Lund

[57] ABSTRACT

Demagnetizing methods and apparatus are provided in which a pipe, tube, rod, bar or other elongated part to be demagnetized is moved through the coil assembly to which pulses of current are applied to produce magnetic field pulses of alternating polarity and of substantially constant durations and magnitudes with a substantially constant repetition rate, each current pulse being effective to produce by the end thereof a reversal of the magnetic field in all portions of the part positioned within the confines of the coil assembly and immediately adjacent thereto, the part being moved longitudinally through the coil assembly at a velocity sufficiently low as to effect demagnetization of all portions of the part. The duration of each current pulse is at least 50 milliseconds and most preferably on the order of 0.5 seconds and the velocity of movement is preferably less than two feet per second. The coil assembly includes two pairs of coils connected in series-aiding relation with the coils of each pair being spaced axially from each other and being adjacent the coil of the other pair. Bridge rectifier circuits are provided for energization with silicon controlled rectifiers and trigger circuits adjustable for accurate balance.

10 Claims, 2 Drawing Figures

TRIGGER CONTROL CIRCUIT
TRIGGER CONTROL CIRCUIT
OSC. CIRCUIT
M

DEMAGNETIZING METHODS AND APPARATUS

This invention relates to methods and apparatus for demagnetizing parts and more particularly to methods and apparatus for demagnetizing elongated parts having solid portions of substantial transverse dimensions.

BACKGROUND OF THE INVENTION

In one type of demagnetizing system of the prior art, a part to be demagnetized is placed within a coil which is connected to an AC line and the part is then withdrawn from the coil until it is well away therefrom after which the energization of the coil may be discontinued. The purpose is to apply magnetic flux in reversing directions starting out with a high flux initially and then gradually reducing the flux down to a very low value.

In another type of system, a part to be demagnetized is placed within a coil to which a current of alternating polarity is applied in a programmed manner, with the current being gradually reduced until it is at a very low value.

The latter type of system, in which a programmed decreasing current is applied, is not suitable for elongated parts because of difficulties in obtaining a coil large enough to apply a field to the entire part. The first type of system, in which the coil is connected to an AC line, is suitable for demagnetization of elongated parts in that such parts can be moved longitudinally through the coil to cause a magnetic field of alternating polarity and of reducing magnitude to be applied to each portion of the part as it moves through and beyond the coil. However, if such parts are inspected and tested afterward it will be found that in many cases, the parts are nowhere near being completely demagnetized and as a result, problems frequently occur. As an example, drill pipe which has become strongly magnetized during a magnetic inspection for defects may be passed through a coil connected to an AC line for the purpose of demagnetizing such pipe but when welding operations are subsequently attempted on the pipe, difficulties may be encountered which are due to strong residual fields within the material of the pipe. With other types of parts, other problems may occur such as the attraction of cuttings and chips to the surfaces of parts on which machining operations are performed.

SUMMARY OF THE INVENTION

This invention was evolved with the general object of overcoming disadvantages of prior demagnetizing methods and apparatus and of providing methods and apparatus which are particularly suitable for the demagnetization of elongated parts and parts having solid portions of substantial transverse dimensions.

The invention is based in part upon the discovery and recognition of the causes of problems which are encountered when prior types of demagnetizing systems are used. The problems are due to a phenomenon similar to that which produces a so-called skin effect in which AC currents are concentrated on the outer surface of a conductor as a result of magnetic flux lines that encircle part but not all of the conductor. The inner parts of a cross-section, being circled by the largest number of flux lines, have higher inductance and hence a greater reactance and the result is a redistribution of current over the cross-section so as to cause the central portions of the conductor, which have the highest reactance, to carry the least current. As a result, the AC resistance of a given wire is greater than the DC resistance thereof. The effect is ordinarily quite small at low frequencies such as power frequencies but is very significant at radio frequencies.

A similar type of skin effect takes place when a member of magnetic material, such as a transformer core, is positioned within a coil connected to an AC line with eddy currents being produced. The AC current produces a flux of alernating polarity which induces an EMF of alternating polarity within the member and to cause flow of alternating current in the part around the axis of the coil. A counter field of alternating polarity is produced by the induced current, in opposition to the applied field. Central portions of the member are encircled by more current than those positioned close to the surface and as a result, the counter field is greatest in the inner portion of the part and smallest at the surface of the part. Consequently, the net field intensity, i.e. the difference between the applied and counter field intensities, is greatest at the skin or outside surface and is reduced at the inside. To reduce eddy current losses, it is known that transformer cores and the like may be laminated which increases the length of peripheral surfaces in which flux is concentrated.

It is found that the phenomenon also has an adverse effect in connection with demagnetizing. Even at relatively low frequencies such as power line frequencies of 50 to 60 Hz, inner portions of a part will not be demagnetized even when the transverse dimensions of the part are relatively small. For example, with a drill pipe having a diameter of four inches and a wall thickness of only about 0.2 to 0.3 inches, it is not possible as a practical matter to obtain effective demagnetization when using a coil connected to a 50 to 60 Hz power line and it is not possible to avoid the welding difficulties mentioned above.

With a hollow part such as drill pipe, positioned within a coil and with the axes of the coil and part being either coincident or parallel, the electromotive forces and currents induced from a change in the magnetic flux are in a circumferential direction and since the portions of the part on the inside surface are linked by more current than those portions on the outside, the counter field is very great at the inside to reduce the effective field at the inside to a very low value, particularly when the rate of change of the field is substantial, as is the case when a current of 50 to 60 Hz is applied.

With solid bars the effect is the same, portions in the center of the cross-section of the solid part being surrounded by more current than portions at the outside surface. It is noted in this connection that the problems are a function of the transverse dimensions of the solid portions of the part, i.e. the wall thickness in the case of a tubular part, the diameter in the case of a solid cylindrical part and the thickness in the case of a part of rectangular cross-section.

In accordance with this invention, an elongated part to be demagnetized is moved through coil means to which pulses of current are applied to produce magnetic field pulses of alternating polarity and of substantially constant durations and magnitudes with a substantially constant repetition rate. Each of the current pulses is effective during application thereof to build up the magnetic flux in the portion of the part within the coil means and has a magnitude and duration sufficient to produce by the end of each such pulse a reversal of the magnetic field in all portions of the part positioned within the influence of the coil means. While supplying such current pulses through the coil means, the part is moved longitudinally therethrough at a velocity low enough to expose each portion of the part to field reversals while positioned within the coil means with such field reversals being of gradually reducing magnitude as the portion moves away from the coil means.

The duration of the current pulses is important because during application of each pulse, the magnetic flux should be allowed to build up to a relatively steady value such that the EMF and the current induced in the part are reduced to low values, to thereby reduce the counter field in the central or inner portions of the part and to thereby obtain a magnetic field reversal in the central or inner portion of the part.

Preferably, each of the current pulses has a duration of on the order of at least 100 milliseconds and most preferably, each pulse has a duration on the order of 1 second which is suitable for many applications. The velocity of movement of the part is also important and the allowable velocity is a function of coil geometry, coil spacing, pulse rate, ampere turns and the magnetic characteristics and geometry of the part. Satisfactory results have been obtained with velocities of up to two feet per second, but higher velocities might be used under appropriate conditions.

With a pulse duration of on the order of 0.5 seconds, it is possible to demagnetize sections of drill pipe having a wall thickness of on the order of 0.3 inches but with wall thicknesses at the coupling ends which are much greater. Other types of parts such as solid rods or bars and having similar transverse dimensions may also be demagnetized. For parts having very large transverse dimensions, the durations of the current pulses may be proportionately increased.

Additional features of the invention relate to arrangements for rectifying and switching of current from an AC supply line for developing the current pulses for application to the coil means.

A further feature of the invention relates to the form of the coil means which may preferably include two sections spaced axially a distance of on the order of the diameter thereof, preferably on the order of from two to four times the diameter thereof. For use with one preferred type of rectifying and switching system, each of the axially spaced coil sections may comprise a pair of coils with one coil of each pair being used for applying a magnetic field pulse of one polarity and the other being used for applying a field pulse of the opposite polarity. Each coil of one section is connected in series-aiding relation to a coil of the other section.

This invention contemplates other objects, features and advantages which will become more fully apparent from the following detailed description taken in conjunction with the accompanying drawings.

DESCRIPTION OF A PREFERRED EMBODIMENT

Figures 1, 2:
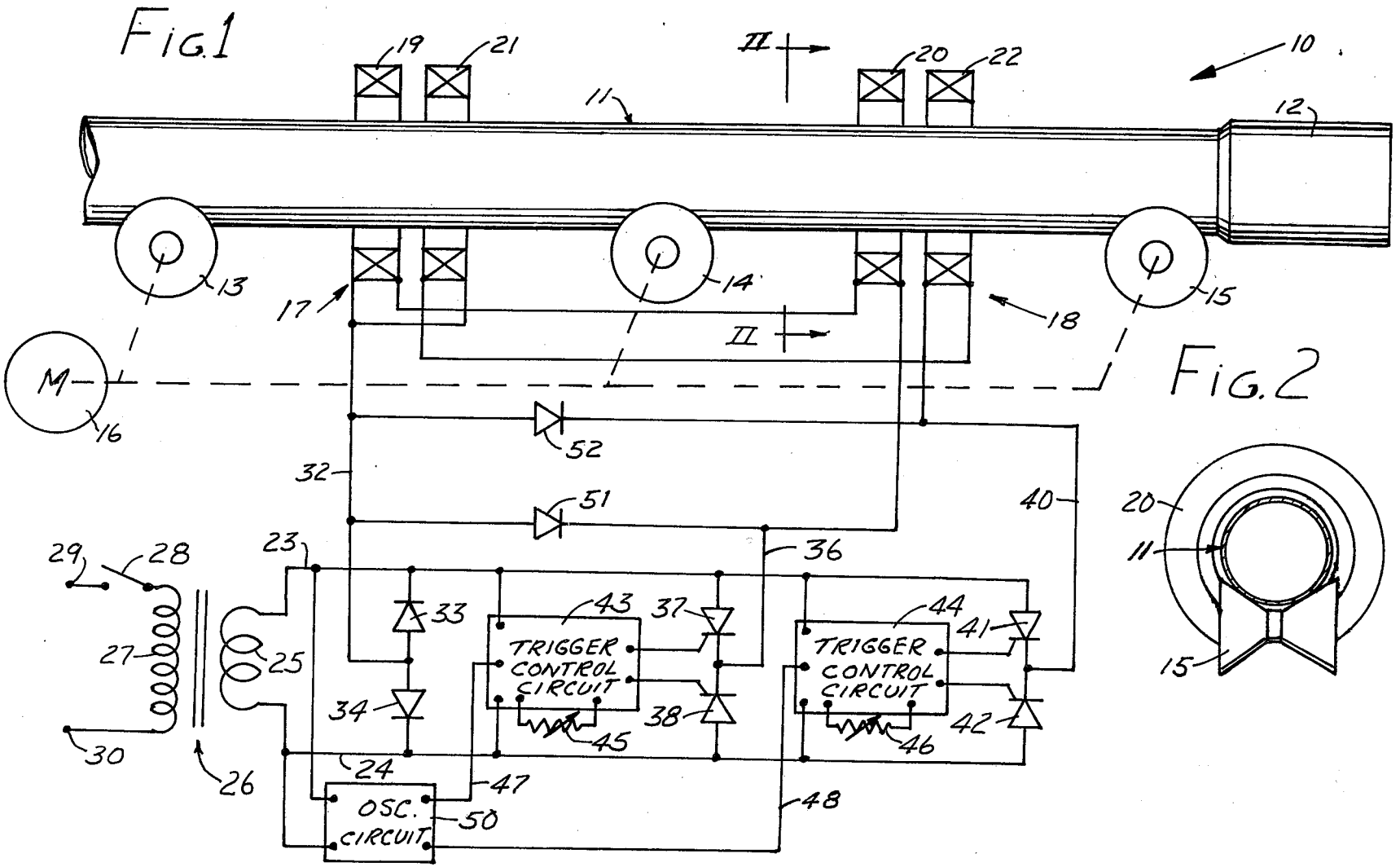
FIG. 1 is a view illustrating diagrammatically a demagnetizing system constructed in accordance with the invention.
FIG. 2 is a sectional view taken substantially along line II—II of FIG. 1.

Reference numeral 10 generally designates a demagnetizing system constructed in accordance with the principles of this invention. The system 10 is designed to demagnetize an elongated part such as a drill pipe section 11 having an upset coupling end portion 12. The pipe 11 is supported for longitudinal movement as by rollers including rollers 13, 14 and 15 driven from a suitable electric motor 16 as diagrammatically illustrated. The pipe 11 is moved through a coil assembly including two axially spaced sections 17 and 18 each of which includes a pair of coils in the illustrated arrangement, with each coil being connected in series-aiding relation to one coil of the other pair. Thus coil 19 of section 17 is connected in series-aiding relation to coil 20 of section 18 and the second coil 21 of section 17 is connected in series-aiding relation to a second coil 22 of the section 18. Uni-directional current pulses are applied to the two pairs of coils, the coils 19 and 20 being effective to develop a magnetic field in one axial direction and the coils 21 and 22 being effective to develop a magnetic field in the opposite axial direction.

To apply the uni-directional current pulses to the two pairs of coils, a rectifier and switching arrangement is provided for energization from a conventional 50 to 60 Hz supply line. In particular, a pair of lines 23 and 24 are provided which may be connected directly to a supply line or which, as illustrated, may be connected to the secondary 25 of a transformer 26 having a primary winding 27 connected through a switch 28 to terminals 29 and 30 for connection to a supply line. A common conductor 32, connected to terminals of both series-connected sets of coils, is connected through rectifier diodes 33 and 34 to the lines 23 and 24. A line 36 which is connected to one terminal of coil 20 is connected to the cathodes of a pair of silicon controlled rectifiers 37 and 38 having anodes connected to the lines 23 and 24. A conductor 40 which is connected to one terminal of coil 22 is connected to the cathodes of a pair of silicon controlled rectifiers 41 and 42 which have anodes connected to the conductors 23 and 24. A pair of trigger control circuits 43 and 44 are provided, connected to the lines 23 and 24 with output terminals of circuit 43 being connected to gate electrodes of rectifiers 37 and 38 and with output terminals of circuit 44 being connected to gate electrodes of rectifiers 41 and 42. The circuits 43 and 44 provide trigger signals to the associated silicon controlled rectifiers to initiate conduction thereof at controlled times, preferably with the exact phase of the triggering signals being controlled, as through adjustable resistors 45 and 46. Circuits 43 and 44 are controlled through lines 47 and 48 from an oscillator circuit 50 to be alternately operated at a low repetition rate of approximately 10 per second or less preferably on the order of 2 per second for most applications. Connections may be provided between the oscillator circuit 50 and the lines 23 and 24 to supply operating current and also for synchronization. If desired, the oscillator circuit 50 may be in the form of a divider circuit to supply output signals at a sub-multiple of the supply line frequency.

In operation, the trigger control circuit 43 is operative for a time interval of predetermined duration, on the order of 0.5 seconds for example, with rectifier 37 and diode 34 being conductive during half cycles of one polarity and with rectifier 38 and diode 33 being operative during half-cycles of the opposite polarity. A reverse-poled diode 51 is provided between conductors 32 and 36 to continue conduction through the coils 19 and 20 and to allow the silicon controlled rectifiers to be cut off. Thus during a time interval of predetermined duration, such as 0.5 seconds, a more or less uniform current is applied through the coils 19 and 20 to apply a magnetic field in one direction to the part 11. During the following time interval of the same duration, rectifiers 41 and 42 are controlled from the trigger circuit 44 in a similar fashion, a reverse-poled diode 52 being connected between lines 32 and 40. Resistors 45 and 46 may be adjusted to obtain an accurate balance between the fields applied in the two opposing directions which is very important in obtaining demagnetization of the part to a very low level. With each of the current pulses being developed during at least several cycles of the supply line voltage and with each having a relatively large duration, the system allows for the dissipation of eddy currents and for a period of steady state conditions prior to each current reversal. Accordingly, the applied field has much greater penetration capabilities and can influence the entire cross-section of the part.

The part should be moved through the coils at a velocity low enough to allow complete demagnetization of all portions of the part. With repetition rates and durations as above specified, the velocity may be on the order of two feet per second or less, for example.

The coils 19–22 may be so wound as to permit operation directly from a conventional line voltage, as indicated above, or from a low-voltage transformer secondary winding such as winding 25 as illustrated. In either case, the number of turns of coils should be kept as low as possible to minimize the inductance and to permit a build-up of magnetic flux to a steady state condition prior to each current reversal.

The system can be used for demagnetizing of solid parts such as rods or bars as well as pipe or other tubular parts.

It will be understood that modifications and variations may be effected without departing from the spirit and scope of the novel concepts of this invention.

We claim as our invention:

1. In a system for demagnetizing elongated parts of ferromagnetic material having solid portions with transverse dimensions of at least 0.2 inches, coil means arranged to surround a portion of an elongated part, current supply means for supplying pulses of current through said coil means for producing magnetic field pulses of alternating polarity and of substantially constant durations and magnitudes with a substantially constant repetition rate, each of said current pulses being continuous and having substantially constant and unvarying magnitude for a time interval having a duration sufficient to produce a magnetic field in a direction reversed from that produced by the preceding pulse and of a uniform magnitude in all portions of the part positioned within said coil means, and means for supporting and moving the part longitudinally through said coil means to expose each portion of the part to magnetic field reversals of gradually reducing magnitude as the portion moves away from said coil means, each of said current pulses having a duration of on the order of at least 50 milliseconds.

2. In a system as defined in claim 1, each of said current pulses having a duration of on the order of 0.5 seconds.

3. In a system as defined in claim 1, said current supply means including means arranged for connection to a source of alternating current at a frequency of on the order of 50 to 60 Hz, and rectifier and switching means for rectifying and switching of said alternating current to develop said current pulses with each said pulse having a duration of at least several times the duration of one-half cycle of said alternating current.

4. In a system as defined in claim 3, said rectifier and switching means being operative to provide full wave rectification and being conductive during at least several consecutive half-cycles of the applied alternating current to develop each of said current pulses.

5. In a system as defined in claim 4, said rectifier and switching means comprising first controlled rectifier means for producing current pulses of one polarity, second controlled rectifier means for producing current pulses of the reverse polarity, means for controlling said first and second rectifier means to initiate conduction thereof and to produce said current pulses of alternating polarity, and first and second diode means respectively associated with said first and second controlled rectifier means and arranged to insure continuous conduction of current to develop each of said current pulses.

6. In a system as defined in claim 1, said coil means comprising a pair of coil sections spaced axially a substantial distance from each other.

7. In a system as defined in claim 6, each of said coil sections including a pair of coils with each coil being connected in series-aiding relation to one coil of the other section, said current supply means being arranged to alternately energize the coils of each section to develop magnetic fields of opposite polarity.

8. In a system as defined in claim 1, said current supply means including adjustment and balance means for adjusting the magnitude of the current used to develop the field of one polarity relative to the magnitude of the current used to develop the field of the opposite polarity to obtain a balance between said fields.

9. In a method of demagnetizing elongated ferromagnetic parts having solid portions with transverse dimensions of at least 0.2 inches, the steps of providing coil means for surrounding a portion of the part, supplying pulses of current to said coil means to produce within said coil means magnetic field pulses of alternating polarity and of substantially constant duration and magnitude with a substantially constant repetition rate, each of current pulses being continuous and having substantially constant and unvarying magnitude for a time interval having a duration sufficient to produce a magnetic field in a direction reversed from that produced by the preceding pulse and of a uniform magnitude in all portions of the part positioned within said coil means, and supporting and moving the part longitudinally through said coil means to expose each portion of the part to magnetic field reversals of gradually reducing magnitude as it is moved away from the said coil means, each of said current pulses having a duration of on the order of at least 50 milliseconds.

10. In a method as defined in claim 9, the step of adjusting the magnitude of the current used to develop a field in one direction relative to the magnitude of the current used to develop a field in the opposite direction to obtain a balance therebetween.

* * * * *